US009027459B2

(12) United States Patent
Spiegl et al.

(10) Patent No.: US 9,027,459 B2
(45) Date of Patent: May 12, 2015

(54) RECIPROCATING PISTON COMPRESSOR WITH DELIVERY RATE CONTROL

(75) Inventors: Bernard Spiegl, Vienna (AT); Tino Lindner-Silwester, Vienna (AT); Peter Dolovai, Vienna (AT); Christian Kernbichler, Enzersdorf an der Fischa (AT)

(73) Assignee: Hoerbiger Kompressortechnik Holding GmbH, Vienna (AT)

( * ) Notice: Subject to any disclaimer, the term of this patent is extended or adjusted under 35 U.S.C. 154(b) by 553 days.

(21) Appl. No.: 13/443,575

(22) Filed: Apr. 10, 2012

(65) Prior Publication Data

US 2012/0260796 A1 Oct. 18, 2012

(30) Foreign Application Priority Data

Apr. 14, 2011 (AT) ..... A 531/2011

(51) Int. Cl.

| | |
|---|---|
| ***F04B 39/08*** | (2006.01) |
| ***F04B 7/00*** | (2006.01) |
| ***F04B 39/10*** | (2006.01) |

(52) U.S. Cl.

CPC ..... *F04B 39/08* (2013.01); *F04B 7/0076* (2013.01); *F04B 39/1053* (2013.01)

(58) Field of Classification Search

CPC .... F04B 7/0076; F04B 39/08; F04B 39/1053; F04B 49/065; F04B 49/243

USPC ..... 91/35, 39, 476, 482, 483; 137/552, 523; 417/297, 298, 446

See application file for complete search history.

(56) References Cited

U.S. PATENT DOCUMENTS

| | | | | |
|---|---|---|---|---|
| 4,515,343 | A | 5/1985 | Pischinger et al. | |
| 5,833,209 | A | 11/1998 | Steinruck | |
| 7,331,767 | B2 | 2/2008 | Spiegl et al. | |
| 7,516,940 | B2 * | 4/2009 | Kopecek et al. | 251/129.16 |
| 2007/0272890 | A1 | 11/2007 | Kopecek et al. | |

FOREIGN PATENT DOCUMENTS

| | | |
|---|---|---|
| DE | 684110 | 11/1939 |
| DE | 849739 | 9/1952 |
| DE | 1251121 | 9/1967 |

* cited by examiner

*Primary Examiner* — Michael Leslie
(74) *Attorney, Agent, or Firm* — Dykema Gossett PLLC

(57) ABSTRACT

In a reciprocating piston compressor with delivery rate control, the electromagnetic actuating device (3) of the valve lifter (2) has a separate positioning drive (10) for adjusting the working stroke range of the magnetic actuator (5) used, whereby this can be chosen to be small and highly dynamic and only low power losses occur.

7 Claims, 2 Drawing Sheets

RECIPROCATING PISTON COMPRESSOR WITH DELIVERY RATE CONTROL

BACKGROUND OF THE INVENTION

1. Field of the Invention

The invention relates to a reciprocating piston compressor with delivery rate control having a valve lifter, which can be electromagnetically operated in the working cycle and is arranged on at least one of the automatic suction valves, for periodically holding the appropriate suction valve open over a defined crank angle range.

2. The Prior Art

So-called return flow control, with which the at least one suction valve per cylinder is held open over a defined range of the compression stroke, is often called upon for controlling the delivery rate of reciprocating piston compressors which preferably run at constant speed. The pressure forces or flow forces of the gas, which is pushed back via the held-open suction valve, can only close the closing element of the respective suction valve after a certain part of the piston stroke has been overcome, as this closing element is subject to an opposing force from the other side which is set according to the required delivery rate reduction. The greater this opposing force, the later in the compression stroke the respective suction valve closes, whereby the delivery rate falls. As, at some point, if the constant opposing force is set too high, the suction valve no longer closes, with this type of compressor control the control range must be limited in a downwards direction in order to avoid the compressor temporarily running on no load with all the problems associated therewith. With these delivery rate control systems, designs have been disclosed with which the loading device for the suction valve to be held open is simply pre-loaded hydraulically or pneumatically, wherein the delivery rate can be affected by varying the appropriate pre-load pressure.

Furthermore, by way of example, a return flow control for reciprocating piston compressors with which a hydraulic control cylinder, which can be charged with pressure medium and relieved periodically in the stroke cycle by means of a control element, acts on the closing element of the suction valve to be held open in the direction of the stroke, is disclosed in EP 694 693 A1. Here, the hydraulically applied lifting force is suddenly reduced at a defined crank angle, as a result of which a reliable and rapid closing of the suction valve is initiated. Similar delivery rate controls with pneumatic actuation are also disclosed in EP 1 400 692 A1, which has the advantage that the actuation force can be derived directly from the reciprocating piston compressor itself. However, because of the relatively high compressibility of the compressed gas, accurately defined conditions for the volumes to be exhausted and the exhaust times must be maintained.

Furthermore, reciprocating piston compressors with an electromagnetically operated return flow control of the kind mentioned in the introduction have been known for a very long time. For example, from DE 1 251 121 A or DE 849 739 B and similar publications, in some cases dating back to the 1930s, in which a valve lifter acting on the sealing element of the suction valve is moved by means of a solenoid, the periodic excitation of which is carried out, for example, by a collector which turns synchronously with the crankshaft of the compressor. The particular characteristic of the actuating force necessary for holding the suction valve open while the suction gas is being pushed back requires a high force from the magnetic actuator, which, with the simultaneous requirement for low heat development, necessitates rather large solenoids. At the same time, the solenoid must be highly dynamic in order to be able to open and close quickly, which if anything cannot be achieved with large solenoids, as the stored energy and the outlay to build up or dissipate current in large solenoids is considerably greater. Especially with arrangements of the kind mentioned in the introduction, heat expansion and wear can cause a displacement of the necessary working stroke range of the magnetic actuator. As solenoids have a very restricted usable working range of a few millimeters stroke length, it would also be necessary to use correspondingly enlarged solenoids in order to be able to still apply correspondingly high actuating forces when the working stroke range is displaced, which further reduces the actuating dynamics. All this previously conflicted with an electromagnetic return flow control of the kind mentioned in the introduction, especially when higher compressor speeds were required and circumstances did not allow the use of separate cooling systems in the vicinity of necessarily large magnetic actuators.

The object of the present invention is to improve an arrangement of the kind mentioned in the introduction so that the stated disadvantages of the related prior art are avoided and that the required high actuating dynamics can also be provided with low heat losses, particularly with small solenoids as actuators of the valve lifter actuating device.

SUMMARY OF THE INVENTION

According to the present invention, this object is achieved in that the electromagnetic actuating device has a separate positioning drive, and that the positioning drive is used as required for displacing the working stroke range of the magnetic actuator used relative to its engagement with the suction valve into the optimum working range for the solenoid used.

In order to be able to use the magnetic actuator for the controlled movement of the valve lifter over the stroke range required for the delivery rate control, this is therefore combined with a separate positioning drive which can work comparatively slowly, as it is only ever used to drive the actual control actuator into the optimum working range for the solenoid. By this means, it is now easily possible to satisfy all requirements regarding force, dynamics and energy expenditure and to make the actual magnetic actuator of the electromagnetic actuating device of the valve lifter smaller by at least a factor of 2. This leads to the dynamics of the control being virtually doubled with relatively low power losses. In an extremely advantageous manner, the high dynamics allow the opening and closing movement of the lifting device to be actively controlled during the stroke of the magnetic actuator. The power losses can therefore be reduced by about 50-70% compared with a single, large magnetic actuator, as the displaced amounts of energy are now significantly less, which even enables a delivery rate control of this kind to be used without external cooling of the magnetic actuators and therefore opens up many new applications for controls of this kind with which external cooling is not possible or not permitted.

A separate positioning drive per se has already been disclosed in DE 684 110 C in the case of electromagnetically actuated compressor valves, although here it is not used for adjusting the working stroke range of the magnetic actuator used but for varying the permissible largest valve stroke which can occur with the electromagnetic control. According to this publication therefore, only the maximum possible opening of the valve is adjusted depending on the operating conditions of the compressor.

In an advantageous embodiment of the invention, the positioning drive acts on the magnetic actuator together with the valve lifter actuated thereby and adjusts their common position relative to the suction valve as required. By this means, the whole lifting device is therefore adjusted relative to the sealing element of the appropriate suction valve, which enables the working stroke range of the magnetic actuator to be easily adjusted relative to its engagement with the suction valve.

According to another preferred embodiment of the invention, the positioning drive can also have a longitudinal adjustment unit for a transmission rod connected between magnetic actuator and valve lifter, whereby the whole lifting device does not need to be adjusted relative to the suction valve, and the working stroke range of the magnetic actuator is adjusted only by lengthening or shortening the transmission rod.

In both of the stated variants, the positioning drive can have an electric-motor-actuated threaded spindle, wherein, as mentioned, this only has to work relatively slowly and therefore manages with small drive forces.

According to another embodiment of the invention, the positioning drive can also act indirectly, preferably via levers, inclined ramps or similar, on the adjustment of the working stroke range of the magnetic actuator, which enables structural modifications to be easily made to suit the particular circumstances and, for example, also allows further miniaturization or, if required, also independent adjustments of the start and end of the stroke.

In a particularly preferred further embodiment, it is provided that the actuating device of the valve lifter has additional spring elements and/or fluid dampers which, with appropriate matching and design, allows the load on the magnetic actuator to be additionally reduced.

In a further preferred embodiment of the invention, the energization of the magnetic actuator can be controlled as a function of the return flow force currently acting on the suction valve. While the suction valve is held open, the level of the return flow force depends on the current piston speed of the compressor, which is known or can be determined by a crank angle sensor. The energization of the magnetic actuator to produce the necessary force to hold the valve open can therefore be matched appropriately, which further reduces the total power consumption and therefore also the heat losses.

BRIEF DESCRIPTION OF THE DRAWINGS

The invention is described in more detail below with reference to the exemplary embodiments which are shown schematically in the drawings.

DETAILED DESCRIPTION OF THE PREFERRED EMBODIMENTS

Figure 1:
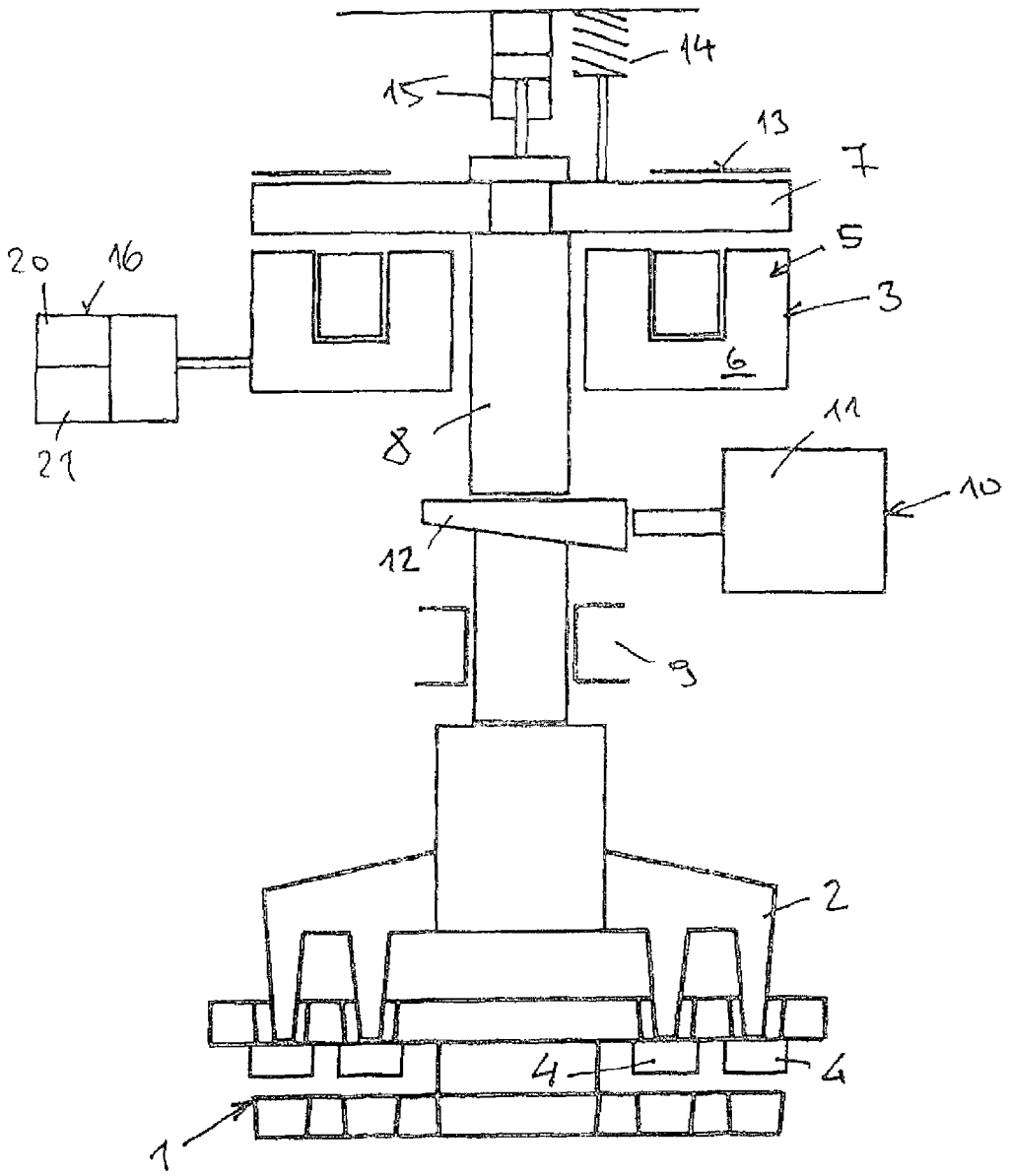
FIG. 1 shows a section through the area of a suction valve of a reciprocating piston compressor with delivery rate control according to the invention.

According to FIG. 1, a reciprocating piston compressor, which is not shown in more detail, has a valve lifter 2 which is arranged on an automatic suction valve 1 of the compressor and which holds two annular sealing elements 4 of the suction valve 1 open over a controllable part of the working cycle of the compressor by means of an electromagnetic actuating device 3. For this purpose, the actuating device 3 has a drive in the form of magnetic actuator 5, the magnetic coil (solenoid) 6 of which acts together with an armature plate 7 which is attached to the top end of a transmission rod 8. In turn, the bottom part of the transmission rod 8 is connected to the valve lifter 2 and is guided in the longitudinal direction by a symbolically shown guide 9.

Furthermore, the electromagnetic actuating device 3 has a separate positioning drive 10, which here, for example, acts via an electric-motor-operated threaded spindle drive 11 and a sliding inclined ramp 12 on the effective length of the transmission rod 8 between magnetic actuator 5 and valve lifter 2. In this way, the periodic electromagnetic actuation of the valve lifter 2 in the working cycle of the reciprocating piston compressor is therefore decoupled from the adjustment of the working stroke range of the magnetic actuator 5 effected by the positioning drive 10.

An upper stop 13 for the retracted position of the valve lifter 2, which is defined, for example, by a spring or similar, which is not shown here, when the actuating device 3 is not activated, is shown on the top of the armature plate 7 along with a spring element 14 and a fluid damper 15, which can also be used independently from one another and which, with appropriate design and matching, enable the load on the electromagnetic actuating device 3 to be reduced.

As soon as the magnetic actuator 5 of the actuating device 3 is energized via the electrical control device 16 and therefore the armature plate 7 is attracted (against a spring which is not shown), the valve lifter 2 moves downwards in the diagram and therefore acts on the otherwise free movement of the sealing elements 4. These can therefore be held open against the automatic actuation, which otherwise results purely from the pressure conditions before and after the suction valve 1, over a controllable part of the compression stroke of the reciprocating piston compressor, which allows the delivery rate of a compressor running at constant speed to be controlled in a known manner using so-called return flow control. At the same time, by means of a circuit element 20 in the control device 16, which is only indicated in FIG. 1, the force of the actuating device 3 which holds the valve open can also be matched to the currently acting return flow force, which can be determined, for example, by a crank angle sensor 21, by controlling the energization, which helps to reduce unnecessary heat losses.

Figure 2:
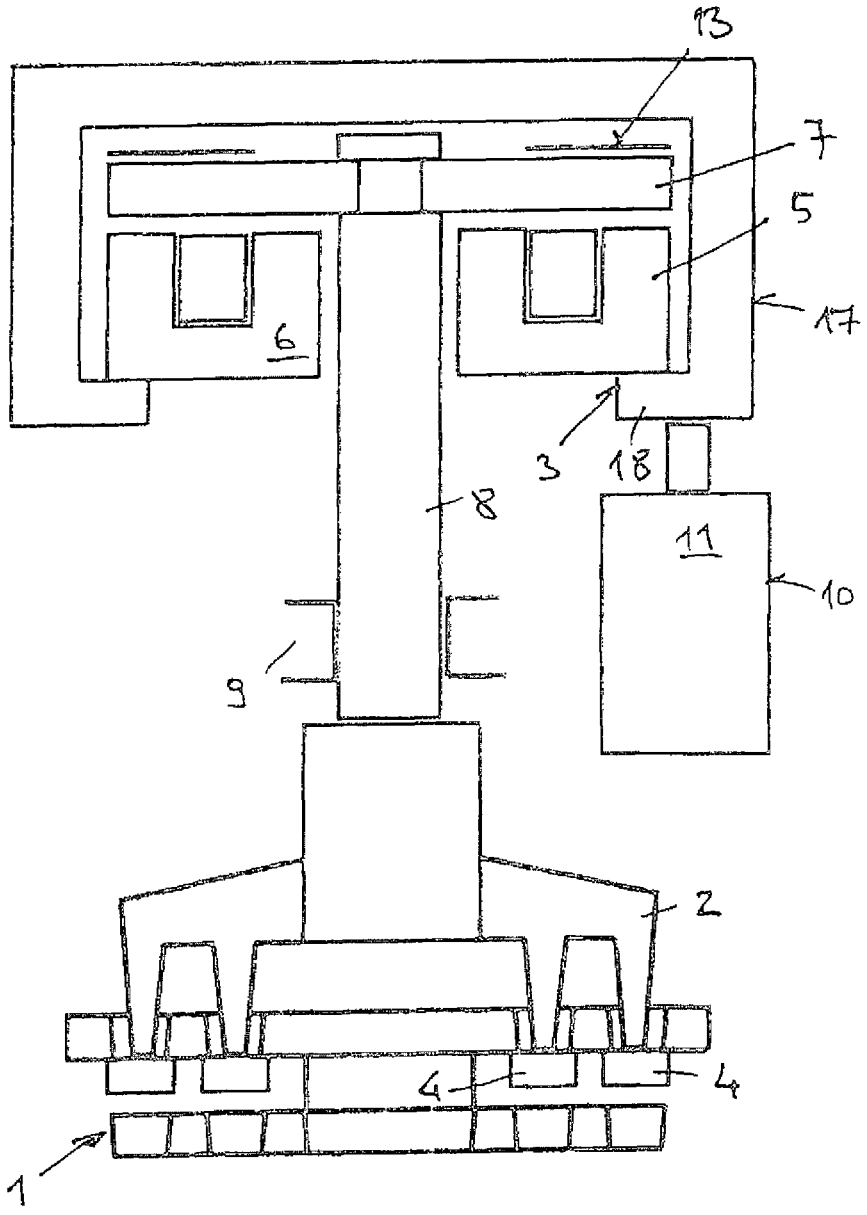
FIG. 2 shows an alternative design in a similar view.

In the embodiment according to FIG. 2, in variance with FIG. 1, the transmission rod 8 between armature plate 7 and valve lifter 2 is now continuous and not variable in length. In order to adjust the working stroke range of the magnetic actuator 5, here the positioning drive 10 acts via a housing 17 or a housing flange 18 jointly on the magnetic actuator 5 together with the valve lifter 2 actuated thereby, whereby their common position relative to the suction valve 2 can be adjusted as required. All further important design details are the same as in FIG. 1—reference is therefore made here to FIG. 1 for the description of the appropriate characteristics and functions.

The invention claimed is:

1. A reciprocating piston compressor with delivery rate control which comprises:

an automatic suction valve, a valve lifter connected to the automatic suction valve for holding the suction valve open over a defined crank angle range, and an electromagnetic actuating device connected to the valve lifter, said electromagnetic actuating device including a magnetic actuator having a solenoid with an optimum working range, and a separate positioning apparatus for displacing a working stroke range of the magnetic actuator relative to the automatic suction valve into the optimum working range of the solenoid.

2. The reciprocating piston compressor as claimed in claim 1, wherein the positioning apparatus acts on the magnetic actuator to adjust the position of the magnetic actuator, and the valve lifter relative to the suction valve.

3. The reciprocating piston compressor as claimed in claim 2, wherein the positioning apparatus includes an electric motor-actuated threaded spindle drive.

4. The reciprocating piston compressor as claimed in claim 1, including a transmission rod that extends between the magnetic actuator and the valve lifter, and wherein the positioning apparatus includes a longitudinal adjustment unit for the transmission rod.

5. The reciprocating piston compressor as claimed in claim 4, wherein the longitudinal adjustment unit includes an inclined ramp for adjusting the working stroke range of the magnetic actuator.

6. The reciprocating piston compressor as claimed in claim 1, wherein the actuating device includes spring elements and/or fluid dampers.

7. The reciprocating piston compressor as claimed in claim 1, including control means for controlling energization of the magnetic actuator as a function of return flow force currently acting on the suction valve.

* * * * *